US009620054B2

(12) United States Patent
Keum et al.

(10) Patent No.: US 9,620,054 B2
(45) Date of Patent: Apr. 11, 2017

(54) TIMING CONTROLLER, ORGANIC LIGHT-EMITTING DIODE (OLED) DISPLAY HAVING THE SAME AND METHOD FOR DRIVING THE OLED DISPLAY

(71) Applicant: Samsung Display Co., Ltd., Yongin, Gyeonggi-Do (KR)

(72) Inventors: Min-Ha Keum, Yongin-si (KR); Woo-Chul Kim, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 81 days.

(21) Appl. No.: 14/663,226

(22) Filed: Mar. 19, 2015

(65) Prior Publication Data

US 2016/0104418 A1 Apr. 14, 2016

(30) Foreign Application Priority Data

Oct. 10, 2014 (KR) ..... 10-2014-0136447

(51) Int. Cl.
*G09G 3/3208* (2016.01)
*G09G 3/20* (2006.01)
*G09G 5/00* (2006.01)

(52) U.S. Cl.
CPC ..... *G09G 3/3208* (2013.01); *G09G 3/2096* (2013.01); *G09G 5/006* (2013.01);
(Continued)

(58) Field of Classification Search
CPC ..... G09G 3/3208; G09G 3/3225; G09G 2320/04; G09G 2320/00; G09G 2330/08;
(Continued)

(56) References Cited

U.S. PATENT DOCUMENTS

2003/0193459 A1 10/2003 Kim et al.
2007/0159490 A1 7/2007 De Greef
(Continued)

FOREIGN PATENT DOCUMENTS

KR 10-2006-0128982 A 12/2006
KR 10-2010-0016994 A 2/2010
(Continued)

OTHER PUBLICATIONS

Extended European Search Report dated Feb. 19, 2016 for European Patent Application No. EP 15 172 185.9 which shares priority of Korean Patent Application No. KR 10-2014-0136447 with subject U.S. Appl. No. 14/663,226.

*Primary Examiner* — Koosha Sharifi-Tafreshi
(74) *Attorney, Agent, or Firm* — Knobbe Martens Olson & Bear LLP

(57) ABSTRACT

A timing controller, OLED display having the same and method of for driving the display are disclosed. The timing controller includes a failure mode determiner that can receive an input signal and determine whether the OLED display is in a failure mode based on the input signal. The timing controller also includes a failure mode generator configured to store a fail signal, output the fail signal in the failure mode, and selectively output a multiplexed signal including one of the input signal or the fail signal based on whether the OLED display is in the failure mode. The timing controller further includes a failure mode controller configured to receive the multiplexed signal from the failure mode generator, store the multiplexed signal, and selectively output the multiplexed signal of a current frame or the multiplexed signal of a previous frame based on whether the OLED display is in the failure mode.

20 Claims, 8 Drawing Sheets

(52) U.S. Cl.
CPC ..... *G09G 2310/08* (2013.01); *G09G 2320/04* (2013.01); *G09G 2330/00* (2013.01); *G09G 2330/12* (2013.01); *G09G 2340/14* (2013.01); *G09G 2340/16* (2013.01); *G09G 2370/04* (2013.01); *G09G 2370/22* (2013.01)

(58) Field of Classification Search
CPC . G09G 3/3648; G09G 2330/12; G09G 3/2096
See application file for complete search history.

(56) References Cited

U.S. PATENT DOCUMENTS

| | | | | |
|---|---|---|---|---|
| 2007/0164969 | A1* | 7/2007 | Kim ..... | G09G 3/3611 345/99 |
| 2009/0096769 | A1 | 4/2009 | Kim et al. | |
| 2009/0177930 | A1* | 7/2009 | Park ..... | G09G 3/2003 714/49 |
| 2010/0033453 | A1 | 2/2010 | Park et al. | |
| 2010/0231601 | A1 | 9/2010 | Sontag et al. | |
| 2013/0215090 | A1 | 8/2013 | Kim et al. | |
| 2014/0184659 | A1 | 7/2014 | Kang et al. | |

FOREIGN PATENT DOCUMENTS

| | | | |
|---|---|---|---|
| KR | 10-2013-0052299 | A | 5/2013 |
| KR | 10-2013-0095574 | A | 8/2013 |

* cited by examiner

TIMING CONTROLLER, ORGANIC LIGHT-EMITTING DIODE (OLED) DISPLAY HAVING THE SAME AND METHOD FOR DRIVING THE OLED DISPLAY

INCORPORATION BY REFERENCE TO ANY PRIORITY APPLICATIONS

This application claims priority under 35 USC §119 to Korean Patent Application No. 10-2014-0136447, filed on Oct. 10, 2014 in the Korean Intellectual Property Office (KIPO), the contents of which are incorporated herein in its entirety by reference.

BACKGROUND

Field

The described technology generally relates to a timing controller, an organic light-emitting diode (OLED) display having the same, and a method for driving the OLED display.

Description of the Related Technology

Flat panel displays (FPDs) are widely used in electronic devices because they are relatively lightweight and thin compared to cathode-ray tube (CRT) displays. Examples of FPDs include liquid crystal displays (LCDs), field emission displays (FEDs), plasma display panel (PDP) displays, and OLED displays. OLED displays have been spotlighted as next-generation displays because they have favorable characteristics such as wide viewing angles, rapid response speeds, thin profiles, low power consumption, etc.

SUMMARY OF CERTAIN INVENTIVE ASPECTS

Some inventive aspects are a timing controller, an OLED display having the timing controller, and a method of driving an OLED display that can prevent a user from recognizing an image defect although an input data is provided in an abnormal timing.

Another aspect is a timing controller that can include a fail mode determining unit configured to receive an input signal, and to determine whether an OLED display operates in a fail mode based on the input signal, a fail mode generating unit configured to store a fail signal to be output in the fail mode, and to output a multiplexed signal by selectively outputting the input signal or the fail signal based on whether the OLED display operates in the fail mode, and a fail mode control unit configured to receive the multiplexed signal from the fail mode generating unit, to store the multiplexed signal received from the fail mode generating unit, and to selectively output the multiplexed signal received in a current frame or the multiplexed signal stored in a previous frame based on whether the OLED display operates in the fail mode.

In example embodiments, the input signal includes input data and a data enable input signal and the fail mode determining unit activates a fail enable signal when the data enable signal is abnormally provided.

In example embodiments, the fail mode control unit includes a memory configured to store the multiplexed signal provided from the fail mode generating unit and a memory control unit configured to generate a mask signal by delaying the fail enable signal for one frame and to control the memory to output the multiplexed signal based on the mask signal.

In example embodiments, the memory control unit controls the memory to output the multiplexed signal stored in the current frame during an inactive period of the mask signal and to output the multiplexed signal stored in the previous frame during an active period of the mask signal.

In example embodiments, the memory control unit deactivates the mask signal when an active period of the mask signal is longer than a predetermined time.

In example embodiments, the fail mode generating unit includes a fail signal storing unit configured to store the fail signal that includes fail data and a data enable fail signal, a first multiplexer configured to selectively output the input data or the fail data based on the fail enable signal, and a second multiplexer configured to selectively output the data enable input signal or the data enable fail signal based on the fail enable signal.

In example embodiments, the fail mode generating unit includes a fail signal storing unit configured to store the fail signal that includes fail data and a data enable fail signal, a first multiplexer configured to selectively output the input data or the fail data based on the fail enable signal, and a second multiplexer configured to selectively output the data enable input signal or the data enable fail signal based on the fail enable signal.

In example embodiments, the first multiplexer outputs the fail data during an active period of the fail enable signal and outputs the input data during an inactive period of the fail enable signal.

In example embodiments, the second multiplexer outputs the data enable fail signal during an active period of the fail enable signal and outputs the data enable input signal during an inactive period of the fail enable signal.

Another aspect is an OLED display that can include a display panel including a plurality of pixels, a scan driver configured to provide a scan signal to the plurality of pixels, a data driver configured to provide a data signal to the plurality of pixels, and a timing controller configured to control the scan driver and the data driver. The timing controller can determine whether the OLED display operates in a fail mode based on an input signal, output a multiplexed signal according to whether the OLED display operates in the fail mode, and selectively output the multiplexed signal received in a current frame or the multiplexed signal stored in a previous frame based on whether the OLED display operates in the fail mode.

In example embodiments, the timing controller includes a fail mode determining unit configured to receive the input signal and to determine whether the OLED display operates in the fail mode based on the input signal, a fail mode generating unit configured to store a fail signal to be output in the fail mode and to output the multiplexed signal by selectively outputting the input signal or the fail signal based on whether the OLED display operates in the fail mode, and a fail mode control unit configured to receive the multiplexed signal from the fail mode generating unit, to store the multiplexed signal received from the fail mode generating unit, and to selectively output the multiplexed signal received in the current frame or the multiplexed signal stored in the previous frame based on whether the OLED display operates in the fail mode.

In example embodiments, the input signal includes input data and a data enable input signal, and the fail mode determining unit activates a fail enable signal when the data enable input signal is abnormally provided.

In example embodiments, the fail mode control unit includes a memory configured to store the multiplexed signal provided from the fail mode generating unit, and a memory control unit configured to generate a mask signal by delaying the fail enable signal for one frame and to control the memory to output the multiplexed signal based on the mask signal.

In example embodiments, the memory control unit controls the memory to output the multiplexed signal stored in the current frame during an inactive period of the mask signal and to output the multiplexed signal stored in the previous frame during an active period of the mask signal.

In example embodiments, the memory control unit deactivates the mask signal when an active period of the mask signal is longer than a predetermined time.

In example embodiments, the fail mode generating unit includes a fail signal storing unit configured to store the fail signal that includes fail data and a data enable fail signal, a first multiplexer configured to selectively output the input data or the fail data based on the fail enable signal, and a second multiplexer configured to selectively output the data enable input signal or the data enable fail signal based on the fail enable signal.

In example embodiments, the first multiplexer outputs the fail data during an active period of the fail enable signal and outputs the input signal during an inactive period of the fail enable signal.

In example embodiments, the second multiplexer outputs the data enable fail signal during an active period of the fail enable signal and outputs the data enable input signal during an inactive period of the fail enable signal.

Another aspect is a method for driving an OLED display that includes a step of receiving an input signal that includes input data and a data enable input signal, a step of generating a fail enable signal that is activated based on the data enable input signal when the OLED display operates in a fail mode, a step of generating a multiplexed signal by selectively outputting the input signal or a fail signal to be output in the fail mode based on the fail enable signal, a step of generating a mask signal by delaying the fail enable signal for one frame, and a step of outputting the multiplexed signal received in a current frame during an inactive period of the mask signal or the multiplexed signal stored in a previous frame during an active period of the mask signal.

In example embodiments, the multiplexed signal is generated by outputting the input data during an inactive period of the fail enable signal and outputting the fail data during an active period of the fail enable signal.

In example embodiments, the mask signal is deactivated when the mask signal has the active period after a predetermined time.

Another aspect is a timing controller for an organic light-emitting diode (OLED) display, comprising a failure mode determiner configured to receive an input signal and determine whether the OLED display is in a failure mode based at least in part on the input signal, a failure mode generator configured to i) store a fail signal, ii) output the fail signal in the failure mode, and iii) selectively output a multiplexed signal including one of the input signal or the fail signal based at least in part on whether the OLED display is in the failure mode, and a failure mode controller configured to i) receive the multiplexed signal from the failure mode generator, ii) store the multiplexed signal, and iii) selectively output the multiplexed signal of a current frame or the multiplexed signal of a previous frame based at least in part on whether the OLED display is in the failure mode.

In the above timing controller, the input signal includes input data and a data enable input signal, wherein the failure mode determiner is configured to activate a fail enable signal when the data enable signal is determined abnormal.

In the above timing controller, the failure mode controller includes a memory configured to store the multiplexed signal. In the above timing controller, the failure mode controller also includes a memory controller configured to i) delay the fail enable signal for one frame so as to generate a mask signal and ii) control the memory to output the multiplexed signal based at least in part on the mask signal.

In the above timing controller, the mask signal includes an active period and an inactive period, wherein the memory controller is further configured to control the memory to i) output the multiplexed signal of the current frame during the inactive period and ii) output the multiplexed signal of the previous frame during the active period.

In the above timing controller, the mask signal has an active period and an inactive period, wherein the memory controller is further configured to deactivate the mask signal when the active period is longer than a predetermined amount of time.

In the above timing controller, the failure mode generator includes a fail signal memory configured to store the fail signal including fail data and a data enable fail signal, a first multiplexer configured to selectively output the input data or the fail data based at least in part on the fail enable signal, and a second multiplexer configured to selectively output the data enable input signal or the data enable fail signal based at least in part on the fail enable signal.

In the above timing controller, the fail enable signal includes an active period and an inactive period, and wherein the first multiplexer is further configured to i) output the fail data during the active period and ii) output the input data during the inactive period.

The timing controller of claim 6, wherein the fail enable signal includes an active period and an inactive period, wherein the second multiplexer is further configured to i) output the data enable fail signal during the active period and ii) output the data enable input signal during the inactive period of the fail enable signal.

Another aspect is an organic light-emitting diode (OLED) display comprising a display panel including a plurality of pixels, a scan driver configured to provide a scan signal to the pixels, a data driver configured to provide a data signal to the pixels, and a timing controller. The timing controller is configured to i) control the scan driver and the data driver, ii) determine whether the OLED display is in a failure mode based at least in part on an input signal, iii) output a multiplexed signal based at least in part on whether the OLED display is in the failure mode, and iv) selectively output the multiplexed signal of a current frame or the multiplexed signal of a previous frame based at least in part on whether the OLED display is in the failure mode.

In the above display, the timing controller includes a failure mode determiner configured to receive the input signal and determine whether the OLED display is in the failure mode based at least in part on the input signal. In the above display, the timing controller also includes a failure mode generator configured to i) store a fail signal, ii) output the fail signal in the failure mode, and iii) selectively output a multiplexed signal include one of the input signal or the fail signal based at least in part on whether the OLED display is in the failure mode. In the above display, the timing controller further includes a failure mode controller configured to i) receive the multiplexed signal from the failure mode generator, ii) store the multiplexed signal, and iii) selectively output the multiplexed signal of the current frame or the multiplexed signal of the previous frame based at least in part on whether the OLED display is in the failure mode.

In the above display, the input signal includes input data and a data enable input signal, wherein the failure mode determiner is configured to activate a fail enable signal when the data enable input signal is determined abnormal.

In the above display, the failure mode controller includes a memory configured to store the multiplexed signal. In the above display, the failure mode controller also includes a memory controller configured to i) delay the fail enable signal for one frame so as to generate a mask signal and ii) control the memory to output the multiplexed signal based at least in part on the mask signal.

In the above display, the mask signal includes an active period and an inactive period, wherein the memory controller is configured to control the memory to i) output the multiplexed signal of the current frame during the inactive period and ii) output the multiplexed signal of the previous frame during the active period.

In the above display, the mask signal has an active period and an inactive period, wherein the memory controller is further configured to deactivate the mask signal when the active period is longer than a predetermined amount of time.

In the above display, the failure mode generator includes a fail signal memory configured to store the fail signal including fail data and a data enable fail signal, a first multiplexer configured to selectively output the input data or the fail data based at least in part on the fail enable signal, and a second multiplexer configured to selectively output the data enable input signal or the data enable fail signal based at least in part on the fail enable signal.

In the above display, the fail enable signal includes an active period and an inactive period, wherein the first multiplexer is further configured to i) output the fail data during the active period and ii) output the input signal during the inactive period.

In the above display, the fail enable signal includes an active period and an inactive period, wherein the second multiplexer is further configured to i) output the data enable fail signal during the active period and ii) output the data enable input signal during the inactive period of the fail enable signal.

Another aspect is a method for driving an organic light-emitting diode (OLED) display, the method comprising receiving an input signal that includes input data and a data enable input signal, generating a fail enable signal to be activated based at least in part on the data enable input signal when the OLED display is in a fail mode, selectively outputting a multiplexed signal including one of the input signal or a fail signal, to be output in the fail mode, based at least in part on the fail enable signal, delaying the fail enable signal for one frame, and outputting the multiplexed signal of a current frame during an inactive period or the multiplexed signal of a previous frame during an active period of the mask signal.

In the above method, the fail enable signal includes an active period and an inactive period, wherein the selectively outputting includes outputting the input data during the inactive period of the fail enable signal and outputting the fail data during the active period of the fail enable signal.

In the above method, the mask signal includes an active period and an inactive period, wherein the mask signal is deactivated when the mask signal has the active period after a predetermined amount of time.

According to at least one of the disclosed embodiments, a timing controller, an OLED display having the same, and a method for driving the OLED display can prevent a user from recognizing an image defect by outputting an image that was displayed in a previous frame when an input data is provided in an abnormal timing.

DETAILED DESCRIPTION OF CERTAIN INVENTIVE EMBODIMENTS

An OLED display can operate in a failure mode in which it displays a predetermined image when corrupt input data is received. A user can recognize an image defect in the form of, for example, display flicker even after returning to a normal mode.

Hereinafter, the described technology will be explained in detail with reference to the accompanying drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
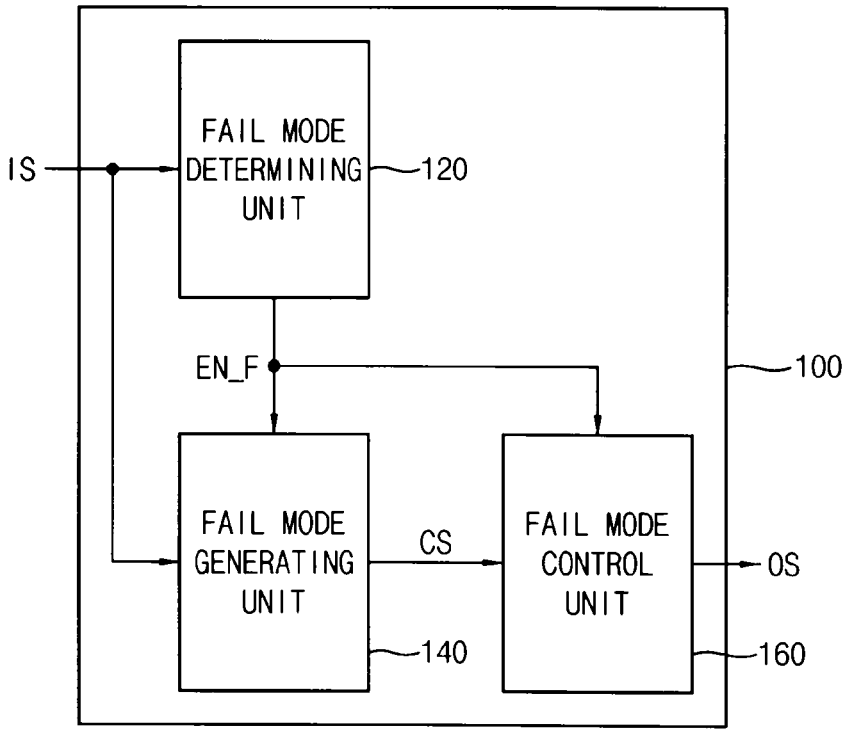
FIG. 1 is a block diagram illustrating a timing controller according to example embodiments.

Referring to FIG. 1, a timing controller 100 includes a failure mode determining unit or failure mode determiner 120, a failure mode generating unit or failure mode generator 140, and a failure mode control unit or failure mode controller 160.

Figure 2:
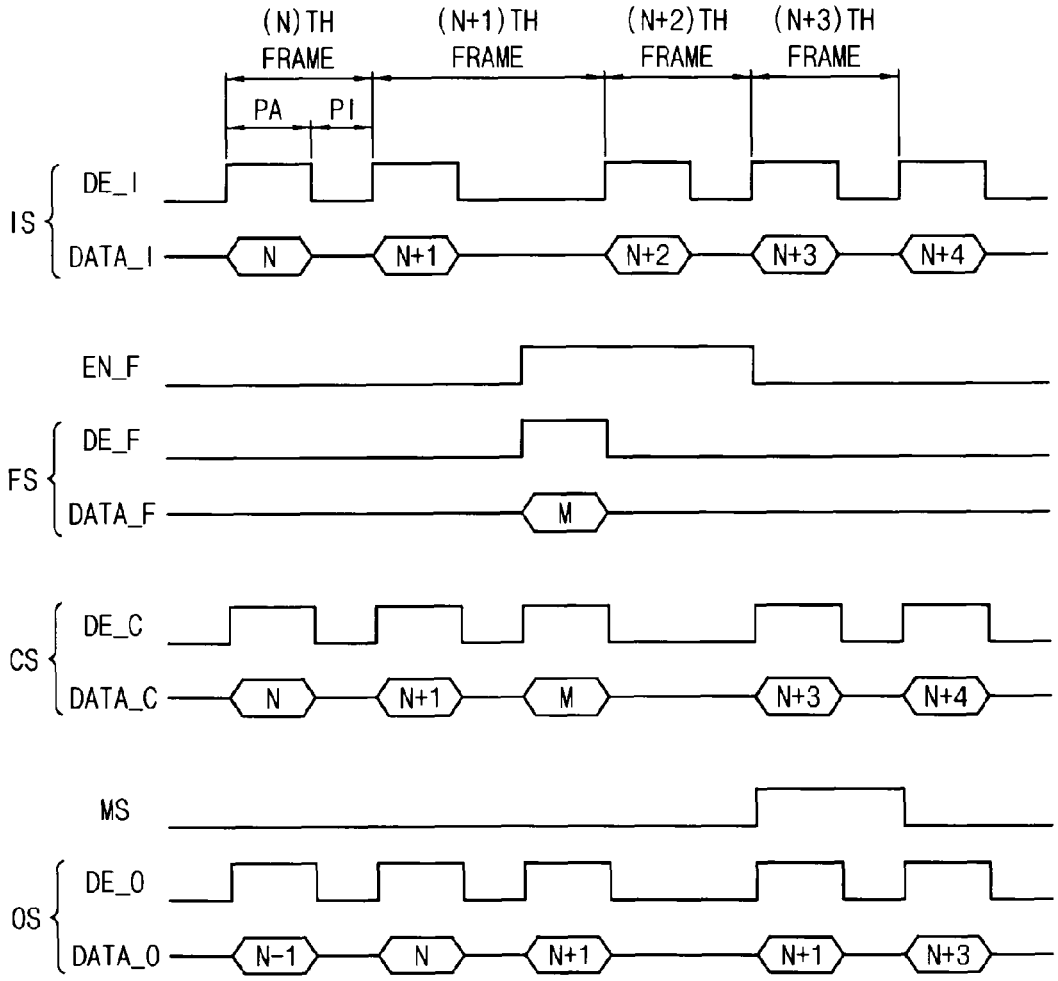
FIG. 2 is a timing diagram illustrating an example for describing an operation of the timing controller of FIG. 1.

The failure mode determining unit 120 can receive an input signal IS from an external system and determine whether an OLED display is operating in a failure mode based on the input signal IS. Referring to FIG. 2, the input signal IS includes input data DATA_I and a data enable input signal DE_I. The input data DATA_I can be provided substantially simultaneously with the data enable input signal DE_I. The data enable input signal DE_I can include an active period PA and an inactive period PI in one frame. Pulses having a predetermined cycle can be provided during the active period PA of the data enable input signal DE_I and, in some embodiments, the pulses are not provided during the inactive period PI of the data enable input signal DE_I. The input data DATA_I can be provided during the active period PA of the data enable input signal DE_I. The data enable input signal DE_I can be abnormally provided because of an external factor such as a static electricity. The failure mode determining unit 120 can activate the fail enable signal EN_F when the data enable input signal DE_I is abnormally input. For example, the failure mode determining unit 120 activates the fail enable signal EN_F when the data enable input signal DE_I is delayed longer than a predetermined amount of time. For example, the fail enable signal EN_F is activated when a data enable input signal DE_I of an (N+2)th frame is not provided after a data input signal DE_I of an (N+1)th frame is provided even though the predetermined amount of time passes as illustrated in FIG. 2. The failure mode determining unit 120 can deactivate the fail enable signal EN_F when the data enable input signal DE_I is normally provided. When a data enable input signal DE_I of an (N+3)th frame provided after the data enable input signal DE_I of the (N+2)th frame is normally provided, the fail enable signal EN_F can be deactivated as illustrated in FIG. 2. The failure mode determining unit 120 can provide the fail enable signal EN_F to the failure mode generating unit 140 and the failure mode control unit 160.

Figure 3:
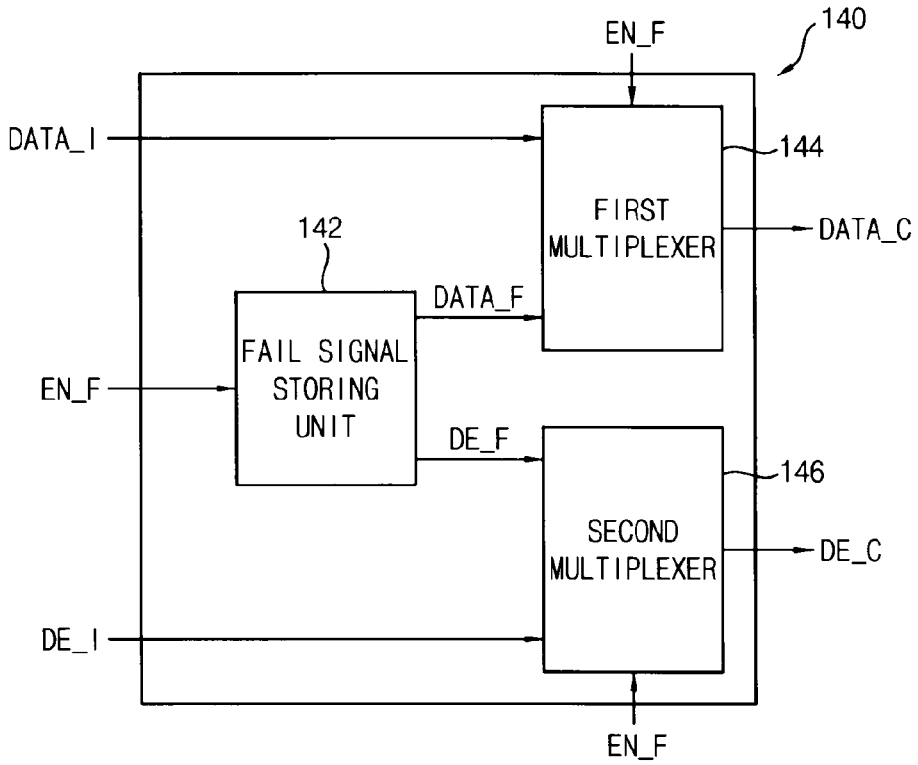
FIG. 3 is a block diagram illustrating a fail mode generating unit included in the timing controller of FIG. 1.

The failure mode generating unit 140 can store a fail signal FS that will be output in the failure mode and can output a multiplexed signal CS by selectively outputting the input signal IS or the fail signal FS based on whether the OLED display is operating in the failure mode. Referring to FIG. 3, the failure mode generating unit 140 includes a fail signal storing unit 142, a first multiplexer 144, and a second multiplexer 146. The fail signal storing unit 142 can store the fail signal FS that will be output in the failure mode. The fail signal FS can be a data signal that displays a predetermined image. For example, the fail signal FS is a data signal that displays a black color image or a mixed color image on the display panel while the OLED display is operating in the failure mode. Referring to FIG. 2, the fail signal FS includes a fail data DATA_F and a data enable fail signal DE_F. The fail data DATA_F can be output in synchronized or substantially simultaneously (hereinafter to be referred to as "substantially simultaneously") with the data enable fail signal DE_F. The first multiplexer 144 can generate a multiplexed data DATA_C by selectively outputting the input data DATA_I or the fail data DATA_F based on the fail enable signal EN_F provided from the failure mode determining unit 120. For example, the first multiplexer 144 generates the multiplexed data DATA_C by outputting the input data DATA_I during an inactive period of the fail enable signal EN_F and outputting the fail data DATA_F during an active period of the fail enable signal EN_F. The second multiplexer 146 can generate a data enable multiplexed signal DE_C by selectively outputting the data enable input signal DE_I or the data enable fail signal DE_F based on the fail enable signal EN_F provided from the failure mode determining unit 120. For example, the second multiplexer 146 generates the data enable multiplexed signal DE_C by outputting the data enable input signal DE_I during the inactive period of the fail enable signal EN_F and outputting the data enable fail signal DE_F during the active period of the fail enable signal EN_F. The multiplexed data DATA_C generated in the first multiplexer 144 and the data enable multiplexed signal DE_C generated in the second multiplexer 146 can be provided to the failure mode control unit 160 as the multiplexed signal CS.

Figure 4:
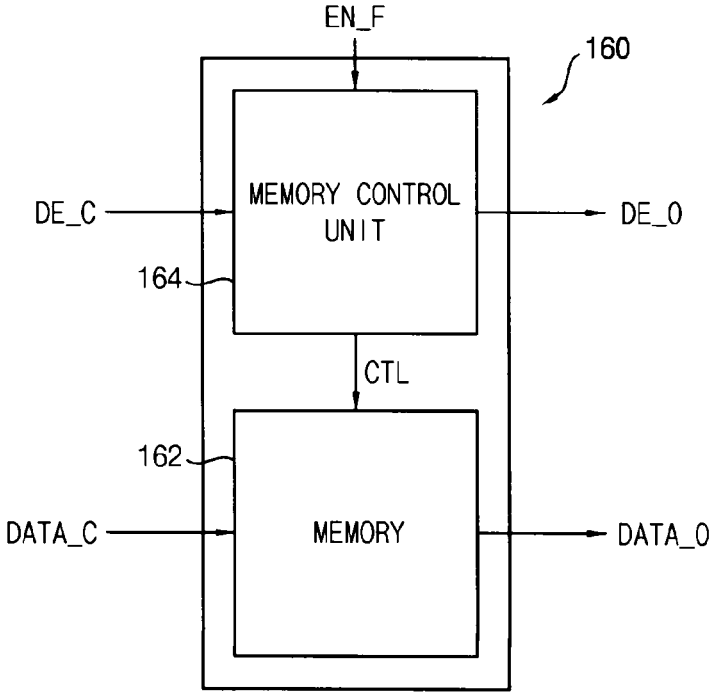
FIG. 4 is a block diagram illustrating a fail mode control unit included in the timing controller of FIG. 1.

The failure mode control unit 160 can receive the multiplexed signal from the failure mode generating unit 140, store the multiplexed signal CS received from the failure mode generating unit 140, and selectively output the multiplexed signal CS received in a current frame or the multiplexed signal stored in a previous frame based on whether the OLED display is operating in the failure mode. Referring to FIG. 4, the failure mode control unit 160 includes a memory 162 and a memory control unit 164. The memory 162 can store the multiplexed data DATA_C provided from the failure mode generating unit 140 per frame and output the multiplexed data DATA_C as an output data DATA_O in response to a control signal CTL provided from the memory control unit 164. Here, the output data DATA_O can be output delayed for one frame. The memory control unit 164 can control the multiplexed data DATA_C stored in the memory 162 based on the fail enable signal EN_F provided from the failure mode determining unit 120 and the data enable multiplexed signal DE_C provided from the failure mode generating unit 140. For example, the memory control unit 164 generates a mask signal MS by delaying the fail enable signal EN_F provided from the failure mode determining unit 120 for one frame. The mask signal MS can be activated and delayed for one frame more than the fail enable signal EN_F as illustrated in FIG. 2. The mask signal MS can be deactivated substantially simultaneously with the data enable multiplexed signal DE_C. The memory control unit 164 can control the memory 162 to output the multiplexed data DATA_C stored in the current frame during an inactive period of the mask signal MS and to output the multiplexed data DATA_C stored in the previous frame during an active period of the mask signal MS. The memory control unit 164 can prevent a user from recognizing an image defect by outputting the multiplexed data DATA_C stored in the previous frame during the active period of the mask signal MS. However, when a channel of an OLED display that is implemented as a television device is changed or when an input source of an OLED display that is implemented as a monitor of a computer device is changed, the fail image based on the fail signal FS should be displayed on a display panel. In this case, the memory control unit 164 can measure a time of an active period of the mask signal MS. When the active period of the mask signal MS is longer than a predetermined time, the memory control unit 164 can deactivate the mask signal MS. Thus, the fail image based on the fail signal FS can be displayed on the display panel by outputting the multiplexed data DATA_C received in the current frame. The memory control unit 164 can control the memory 162 in various methods. For example, the memory 162 includes a plurality of data storing blocks, and the memory control unit 164 reads or writes data that is stored in the data storing block using an address pointer. In this case, the memory control unit 164 can increase the address pointer during the inactive period of the mask signal MS and can maintain the address pointer during the active period of the mask signal MS. The memory control unit 164 can output the data enable multiplexed signal DE_C provided from the failure mode generating unit 140 as the data enable output signal DE_O. The output data DATA_O of the memory 162 can be output substantially simultaneously with the data enable output signal DE_O as the output signal OS.

As described above, the timing controller 100 according to example embodiments generates the mask signal MS according to the data enable fail signal EN_F and outputs the multiplexed data DATA_C stored in the previous frame during an active period of the mask signal MS when the input signal IS is abnormally provided. Thus, the timing controller 100 can prevent the user from recognizing the image defect by outputting the input signal IS stored in the previous frame, not the fail signal FS, although the OLED display is operating in the failure mode because of the abnormal input signal IS.

Figure 5:
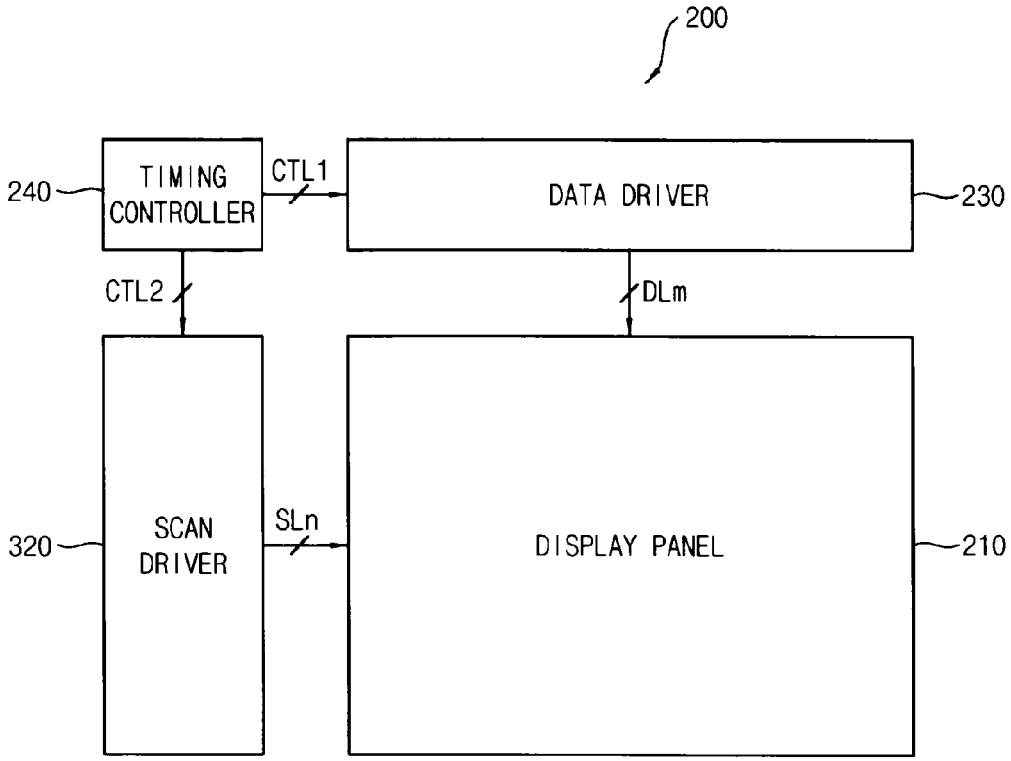
FIG. 5 is a block diagram illustrating an OLED display according to example embodiments.

FIG. 5 is a block diagram illustrating an OLED display according to example embodiments.

Referring to FIG. 5, an OLED display 200 includes a display panel 210, a scan driver 220, a data driver 230, and a timing controller 240. The timing controller 240 of FIG. 5 can correspond to the timing controller 100 of FIG. 1.

A plurality of pixels can be formed on the display panel 210. The pixels can be formed in an intersection region of a plurality of data lines DLm and a plurality of scan lines SLn. In some embodiments, each of the pixels includes a pixel circuit, a driving transistor, and an organic light-emitting diode (OLED). In this case, the pixel circuit can control a current flowing through the OLED based on a data signal, where the data signal is provided via the data line DLm in response to the scan signal, where the scan signal is provided via the scan line SLn. The OLED can emit light based on the current.

The scan driver 220 can provide a scan signal to the pixels via the scan lines SLn. The data driver 230 can provide a data signal to the pixels via the data lines DLm according to the scan signal.

The timing controller 240 can determine whether the OLED display is operating in a failure mode based on the input signal, generate a multiplexed signal according to whether the OLED is operating in the failure mode, and output a multiplexed signal stored in a previous frame when the OLED display is operating in the failure mode. Further, the timing controller 240 can include a control signal generating unit or control signal generator. The control signal generating unit can generate a scan control signal CTL1 that controls the scan driver 220 based on the data enable output signal and a data control signal CTL2 that controls the data driver 230 based on the data enable output signal.

Figure 6:
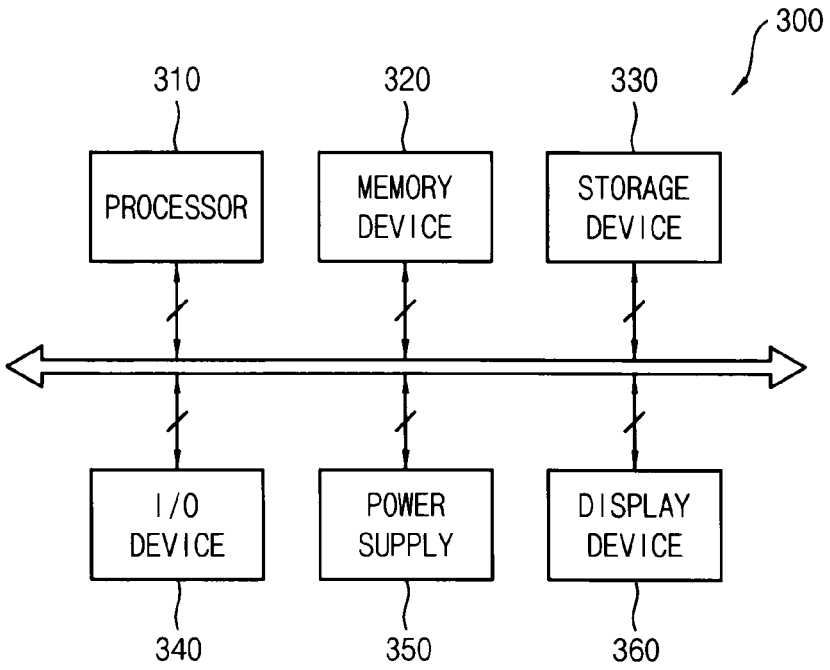
FIG. 6 is a block diagram illustrating an electronic device that includes the OLED display of FIG. 5.
Figure 7:
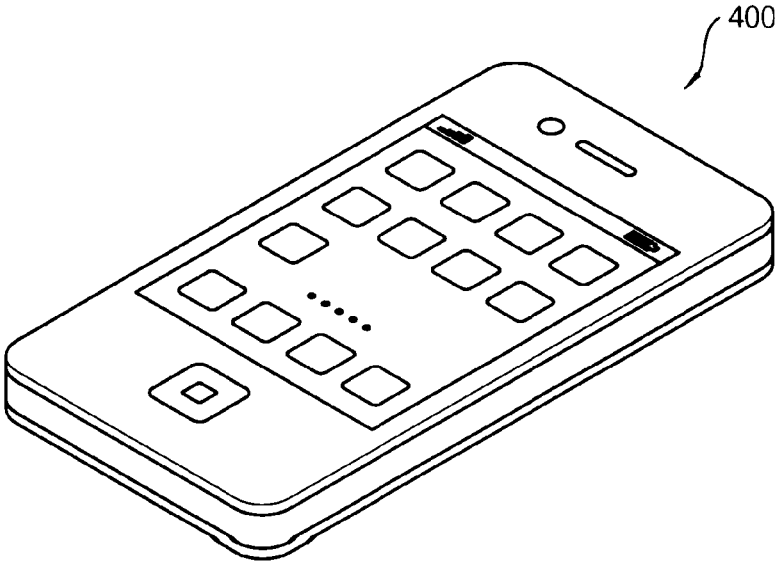
FIG. 7 is a diagram illustrating an example of the electronic device of FIG. 6 that is implemented as a smartphone.

FIG. 6 is a block diagram illustrating an electronic device that includes the OLED display of FIG. 5 and FIG. 7 is a diagram illustrating an example of the electronic device of FIG. 6 implemented as a smartphone.

Referring to FIGS. 6 and 7, the electronic device 300 can include a processor 310, a memory device or memory 320, a storage device 330, an input/output (I/O) device 340, a power supply 350, and a display device 360. Here, the display device 360 can correspond to the display device 200 of FIG. 5. In addition, the electronic device 300 can further include a plurality of ports for communicating with video cards, sound cards, memory cards, universal serial bus (USB) devices, other electronic devices, etc. Although it is illustrated in FIG. 7 that the electronic device 300 is implemented as a smartphone 400, a kind of the electronic device 300 is not limited thereto.

The processor 310 can perform various computing functions. The processor 310 can be a microprocessor, a central processing unit (CPU), etc. The processor 310 can be coupled to other components via an address bus, a control bus, a data bus, etc. Further, the processor 310 can be coupled to an extended bus such as peripheral component interconnect (PCI) bus. The memory device 320 can store data for operations of the electronic device 300. The memory device 320 can include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 330 can include a solid state drive (SSD) device, a hard disk drive (HDD) device, a CD-ROM device, etc.

The I/O device 340 can be an input device such as a keyboard, a keypad, a touchpad, a touch-screen, a mouse, etc., and an output device such as a printer, a speaker, etc. In some embodiments, the display device 360 is included in the I/O device 340. The power supply 350 can provide power for operations of the electronic device 300. The display device 360 can communicate with other components via the buses or other communication links.

Figure 8:
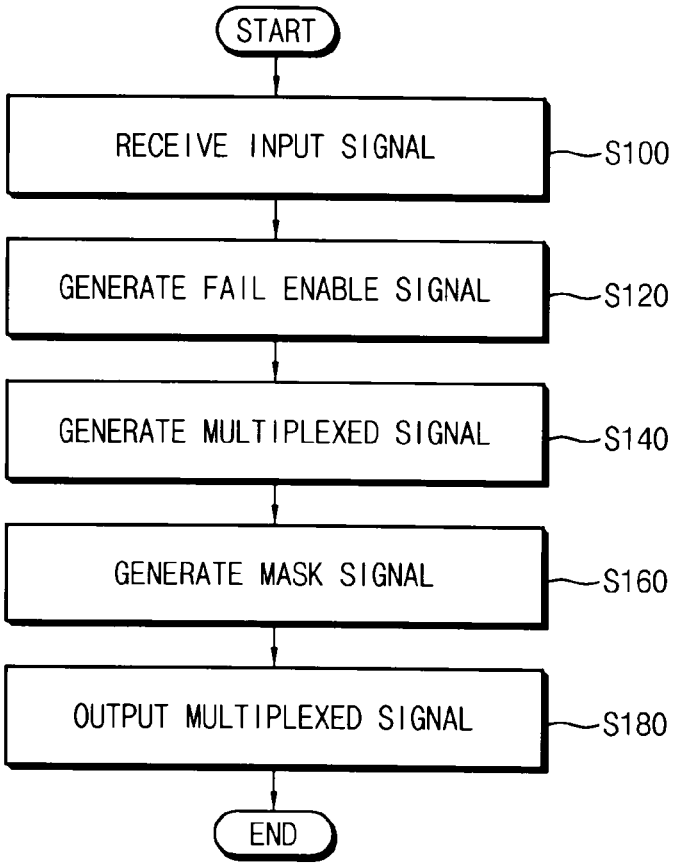
FIG. 8 is a flowchart illustrating a method for driving an OLED display according to example embodiments.

FIG. 8 is a flowchart illustrating a method for driving an OLED display according to example embodiments.

In some embodiments, the FIG. 8 procedure is implemented in a conventional programming language, such as C or C++ or another suitable programming language. The program can be stored on a computer accessible storage medium of the OLED display 200, for example, a memory (not shown) of the OLED display 200 or the timing controller 240. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 8.

Referring to FIG. 8, the method for driving an OLED display includes receiving an input signal that includes input data and a data enable input signal (S100), generating a fail enable signal that is activated based on the data enable input signal when the OLED display is operating in a failure mode (S120), and outputting a multiplexed signal by selectively outputting the input signal or a fail signal output in the failure mode based on the fail enable signal (S140). The method for driving the OLED display also includes generating a mask signal by delaying the fail enable signal for one frame (S160) and outputting the multiplexed signal received in a current frame during an inactive period of the mask signal or the multiplexed signal stored in a previous frame during an active period of the mask signal (S180).

For example, the method for driving the OLED display of FIG. 8 can include receiving the input signal that includes the input data and the data enable input signal (S100). The data enable input signal can include an active period and an inactive period. In some embodiments, pulses having a predetermined cycle can be provided during the active period of the data enable input signal and the pulses are not provided during the inactive period of the data enable input signal. The input data can be provided during the active period of the data enable input signal. The data enable signal can be abnormally provided because of an external factor such as a static electricity.

The method for driving the OLED display of FIG. 8 can include generating the fail enable signal that is activated based on the data enable input signal when the OLED display is operating in a failure mode (S120). The fail enable signal can be activated when the data enable signal is delayed longer than a predetermined amount of time. Further, the fail enable signal can be deactivated when the data enable input signal is normally provided.

The method for driving the OLED display of FIG. 8 can include generating the multiplexed signal by selectively outputting the input signal or a fail signal to be output in the failure mode based on the fail enable signal (S140). The fail data can be a data signal that outputs a predetermined image. The fail data can be output substantially simultaneously with the data enable fail signal. The fail data and the data enable fail signal can be stored in a fail signal storing unit. A fail signal can include the fail data and the data enable fail signal. For example, the fail signal includes a data signal that displays a black color image or a mixed color image on the display panel while the OLED display is operating in the failure mode. A multiplexed data can be generated by outputting the input data during an inactive period of the fail enable signal and by outputting the fail data during an active period of the fail enable signal. Further, a data enable multiplexed signal can be generated by outputting the data enable input signal during the inactive period of the fail enable signal and by outputting the data enable fail signal during the active period of the fail enable signal.

The method for driving the OLED display of FIG. 8 can include generating the mask signal by delaying the fail enable signal for one frame (S160). The mask signal can be activated and delayed for one frame more than the fail enable signal. The mask signal can be deactivated substantially simultaneously with the data enable multiplexed signal. When the active period of the mask signal is longer than a predetermined time, the mask signal can be deactivated.

The method for driving the OLED display of FIG. 8 can include outputting the multiplexed signal received in a current frame during the inactive period of the mask signal or multiplexed signal stored in the previous frame during the active period of the mask signal (S180). The multiplexed data received in the current frame can be output during the inactive period of the mask signal. The multiplexed data stored in the previous frame can be output during the active period of the mask signal. A user can be prevented from recognizing an image defect by outputting the multiplexed data stored in the previous frame during the active period of the mask signal. However, when a channel of an OLED display that is implemented as a television device is changed or when an input source of an OLED display that is implemented as a monitor of a computer device is changed, the fail image based on the fail signal should be displayed on a display panel. When the active period of the mask signal is longer than a predetermined time, the mask signal can be deactivated. Thus, the image based on the fail signal can be displayed on the display panel by outputting the multiplexed data received in the current signal.

The output data that is generated by controlling an output of the multiplexed signal based on the mask signal can be output substantially simultaneously with the data enable output signal. Here, a data enable multiplexed signal can be output as the data enable output signal. The output data can be generated and delayed for one frame. As described above, the method for driving the OLED display can prevent the user from recognizing the image defect by outputting the input signal of the previous frame, not the fail signal, although the OLED display is operating in the failure mode because of the abnormal input signal.

Figure 9:
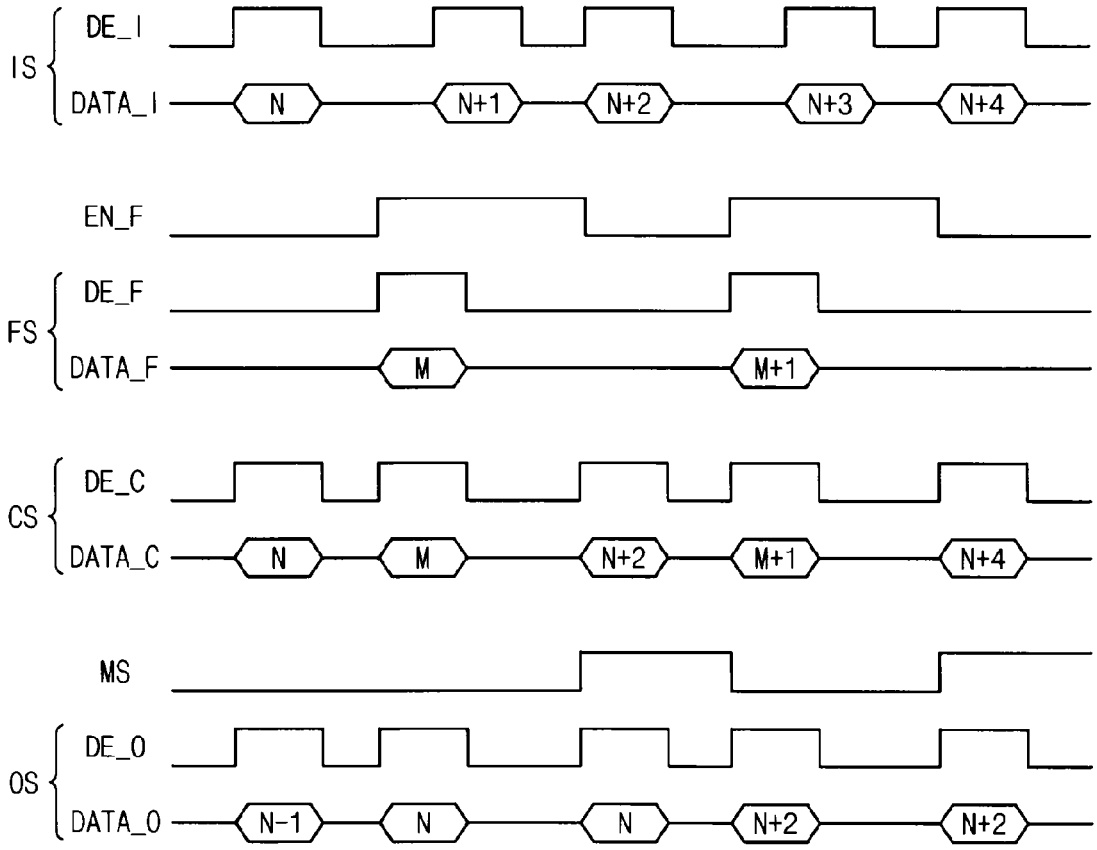
FIG. 9 is a timing diagram illustrating an example for describing the method for driving the OLED display of the FIG. 8.

FIG. 9 is a timing diagram illustrating an example for describing the method for driving the OLED display of the FIG. 8.

Referring to FIG. 9, an input signal IS includes a data enable input signal DE_I and input data DATA_I. When the data enable input signal DE_I is abnormally input, a fail enable signal EN_F can be activated. As illustrated in FIG. 9, when the data enable input signal DE_I of an (N+1)th frame and the data enable input signal DE_I of an (N+3)th frame is delayed, the fail enable signal EN_F is activated. The activated fail enable signal EN_F can be deactivated when the data enable input signal DE_I is normally input. A multiplexed signal CS can be generated based on a fail enable signal EN_F. The multiplexed signal CS can be generated by outputting different signals during an active period of the fail enable signal EN_F and an inactive period of the fail enable signal EN_F. For example, the OLED display includes a fail signal storing unit that stores a fail signal FS. The OLED display can display a predetermined image based on the fail signal FS when the OLED display is operating in a failure mode. The fail signal FS can include a fail data DATA_F and a data enable fail signal DE_F. The data enable multiplexed signal DE_C can be generated by outputting the data enable input signal DE_I during the inactive period of the fail enable signal EN_F and outputting the data enable fail signal DE_F during the active period of the fail enable signal EN_F. Further, the multiplexed data DATA_C can be generated by outputting the input data DATA_I during the inactive period of the fail enable signal EN_F and by outputting the fail data DATA_F during the active period of the fail enable signal EN_F. A mask signal MS can be generated by delaying the fail enable signal EN_F for one frame. The data enable multiplexed signal DE_C can be output as a data enable output signal DE_O. The output data DATA_O can be generated based on the mask signal MS. The output data DATA_O can be generated by outputting the multiplexed data DATA_C received in a current frame during the inactive period of the mask signal MS and by outputting the multiplexed data DATA_C stored in the previous frame during the active period of the mask signal MS. The output data DATA_O can be output substantially simultaneously with the data enable output signal DE_O as an output signal OS. As described above, the user can be prevented from recognizing the image defect by outputting the multiplexed data DATA_C stored in the previous frame during the active period of the mask signals MS.

Figure 10:
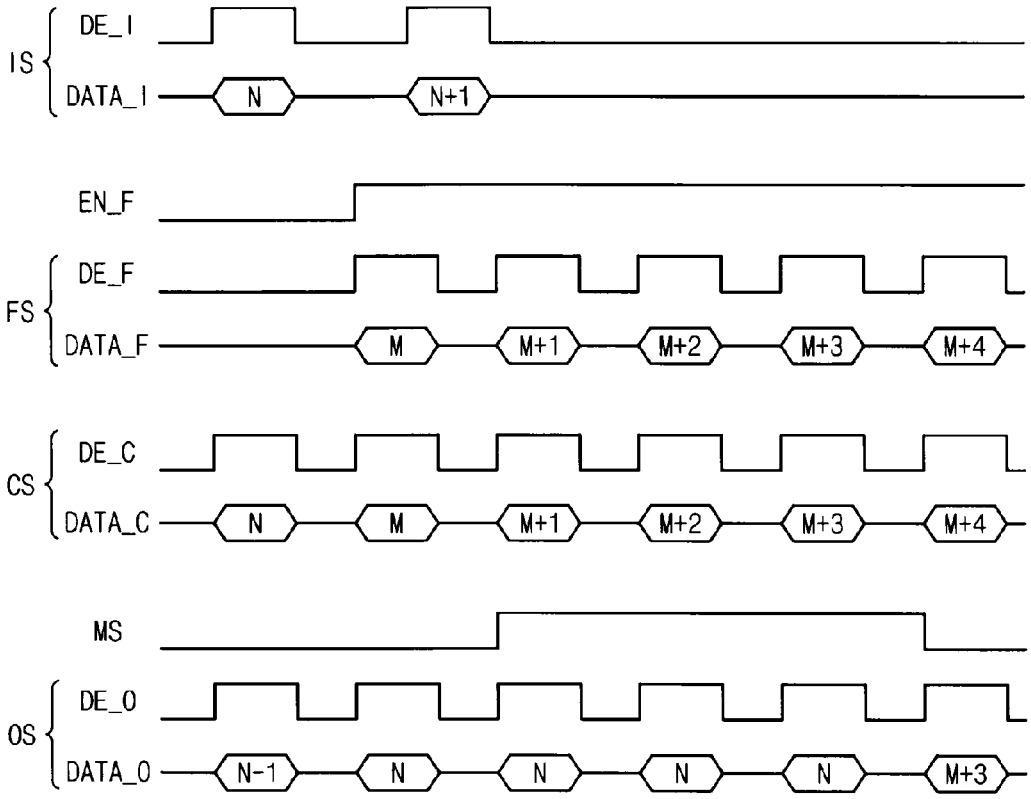
FIG. 10 is a timing diagram illustrating another example for describing the method for driving the OLED display of the FIG. 8.

FIG. 10 is a timing diagram illustrating another example for describing the method for driving the OLED display of the FIG. 8.

Referring to FIG. 10, an input signal IS includes a data enable input signal DE_I and an input data DATA_I. When the data enable input signal DE_I is abnormally input, a fail enable signal EN_F can be activated. In case that a data enable input signal DE_I of an (N+1)th frame is delayed, the fail enable signal EN_F can be activated. When a channel of an OLED display that is implemented as a television device is changed or when an input source of an OLED display that is implemented as a monitor of a computer device is changed, the fail enable signal EN_F can maintain an active state as illustrated in FIG. 10. A multiplexed signal CS can be generated based on the fail enable signal EN_F. The multiplexed signal CS can be generated by outputting different signals during an active period of the fail enable signal EN_F and an inactive period of the fail enable signal EN_F. For example, the OLED display includes a fail signal storing unit that stores a fail signal FS. The OLED display can output a predetermined image based on the fail signal FS when the OLED display is operating in a failure mode. A data enable multiplexed signal DE_C can be generated by outputting the data enable input signal DE_I during an inactive period of the fail enable signal EN_F and by outputting the data enable fail signal DE_F during an active period of the fail enable signal EN_F. Further, multiplexed data DATA_C can be generated by outputting the input data DATA_I during the inactive period of the fail enable signal EN_F and by outputting the fail data DATA_F during the active period of the fail enable signal EN_F. A mask signal MS can be generated by delaying the fail enable signal EN_F for one frame. However, when the fail enable signal EN_F maintains the active state for a predetermined time, the mask signal MS can be deactivated after the predetermined time. The data enable multiplexed signal DE_C can be output as the data enable output signal DE_O. The output data DATA_O can be generated based on the mask signal MS. The output data DATA_O can be generated by outputting the multiplexed signal DATA_C received in a current frame during the inactive period of the mask signal MS and by outputting the multiplexed data DATA_C stored in the previous frame during the active period of the mask signal. Here, an image generated by the fail signal FS can be displayed on the display panel by inactivating the mask signal after the predetermined time although the fail enable signal EN_F still maintain the active state. For example, when a channel of the OLED display that is implemented as a television device is changed or when an input source of the OLED display that is implemented as a computer device is changed, the image generated by the fail signal FS is displayed on the display panel by inactivating the mask signal MS after the predetermined time. As described above, when the input signal IS is abnormally input for more than the predetermined time, the image generated by the fail signal FS, not the input signal IS, is displayed on the display panel by inactivating the mask signal MS after the predetermined time.

The described technology can be applied to an electronic device having a display device. For example, the described technology is applied to computer monitors, laptop computers, digital cameras, cellular phones, smartphones, smart pads, televisions, personal digital assistants (PDAs), portable multimedia players (PMPs), MP3 players, navigation systems, game consoles, video phones, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A timing controller for an organic light-emitting diode (OLED) display, comprising:

a failure mode generator configured to i) store a fail signal, ii) output the fail signal when the OLED display is in a failure mode, and iii) selectively output a multiplexed signal including one of an input signal or the fail signal based at least in part on whether the OLED display is in the failure mode; and a failure mode controller configured to i) receive the multiplexed signal from the failure mode generator, ii) store the multiplexed signal, and iii) selectively output the multiplexed signal of a current frame or the multiplexed signal of a previous frame based at least in part on whether the OLED display is in the failure mode.

2. The timing controller of claim 1, wherein the input signal includes input data and a data enable input signal, and wherein the failure mode generator is configured to output an activated fail enable signal when the data enable signal is determined to be abnormal.

3. The timing controller of claim 2, wherein the failure mode controller includes:

a memory configured to store the multiplexed signal; and a memory controller configured to i) delay the fail enable signal for one frame so as to generate a mask signal and ii) control the memory to output the multiplexed signal based at least in part on the mask signal.

4. The timing controller of claim 3, wherein the mask signal includes an active period and an inactive period, and wherein the memory controller is further configured to control the memory to i) output the multiplexed signal of the current frame during the inactive period and ii) output the multiplexed signal of the previous frame during the active period.

5. The timing controller of claim 3, wherein the mask signal has an active period and an inactive period, and wherein the memory controller is further configured to deactivate the mask signal when the active period is longer than a predetermined amount of time.

6. The timing controller of claim 2, wherein the failure mode generator includes:

a fail signal memory configured to store the fail signal including fail data and a data enable fail signal;

a first multiplexer configured to selectively output the input data or the fail data based at least in part on the fail enable signal; and a second multiplexer configured to selectively output the data enable input signal or the data enable fail signal based at least in part on the fail enable signal.

7. The timing controller of claim 6, wherein the fail enable signal includes an active period and an inactive period, and wherein the first multiplexer is further configured to i) output the fail data during the active period and ii) output the input data during the inactive period.

8. The timing controller of claim 6, wherein the fail enable signal includes an active period and an inactive period, and wherein the second multiplexer is further configured to i) output the data enable fail signal during the active period and ii) output the data enable input signal during the inactive period of the fail enable signal.

9. An organic light-emitting diode (OLED) display comprising:

a display panel including a plurality of pixels;

a scan driver configured to provide a scan signal to the pixels;

a data driver configured to provide a data signal to the pixels; and a timing controller configured to i) control the scan driver and the data driver, ii) determine whether the OLED display is in a failure mode based at least in part on an input signal, iii) output a multiplexed signal based at least in part on whether the OLED display is in the failure mode, and iv) selectively output a) the multiplexed signal of a current frame when the OLED display is not in the failure mode or b) the multiplexed signal of a previous frame when the OLED display is in the failure mode.

10. The display of claim 9, wherein the timing controller includes:

a failure mode generator configured to i) store a fail signal, ii) output the fail signal when the OLED display is in the failure mode, and iii) selectively output a multiplexed signal include one of the input signal or the fail signal based at least in part on whether the OLED display is in the failure mode; and a failure mode controller configured to i) receive the multiplexed signal from the failure mode generator, ii) store the multiplexed signal, and iii) selectively output the multiplexed signal of the current frame or the multiplexed signal of the previous frame based at least in part on whether the OLED display is in the failure mode.

11. The display of claim 10, wherein the input signal includes input data and a data enable input signal, and wherein the failure mode generator is configured to output an activated fail enable signal when the data enable input signal is determined to be abnormal.

12. The display of claim 11, wherein the failure mode controller includes:

a memory configured to store the multiplexed signal; and a memory controller configured to i) delay the fail enable signal for one frame so as to generate a mask signal and ii) control the memory to output the multiplexed signal based at least in part on the mask signal.

13. The display of claim 12, wherein the mask signal includes an active period and an inactive period, and wherein the memory controller is configured to control the memory to i) output the multiplexed signal of the current frame during the inactive period and ii) output the multiplexed signal of the previous frame during the active period.

14. The display of claim 12, wherein the mask signal has an active period and an inactive period, and wherein the memory controller is further configured to deactivate the mask signal when the active period is longer than a predetermined amount of time.

15. The display of claim 12, wherein the failure mode generator includes:

a fail signal memory configured to store the fail signal including fail data and a data enable fail signal;

a first multiplexer configured to selectively output the input data or the fail data based at least in part on the fail enable signal; and a second multiplexer configured to selectively output the data enable input signal or the data enable fail signal based at least in part on the fail enable signal.

16. The display of claim 15, wherein the fail enable signal includes an active period and an inactive period, and wherein the first multiplexer is further configured to i) output the fail data during the active period and ii) output the input signal during the inactive period.

17. The display of claim 15, wherein the fail enable signal includes an active period and an inactive period, and wherein the second-multiplexer is further configured to i) output the data enable fail signal during the active period and ii) output the data enable input signal during the inactive period of the fail enable signal.

18. A method for driving an organic light-emitting diode (OLED) display, the method comprising:

receiving an input signal that includes input data and a data enable input signal;

generating a fail enable signal to be activated based at least in part on the data enable input signal when the OLED display is in a fail mode;

selectively outputting a multiplexed signal including one of the input signal or a fail signal, to be output in the fail mode, based at least in part on the fail enable signal;

delaying the fail enable signal for one frame to generate a mask signal; and selectively outputting i) the multiplexed signal of a current frame during an inactive period when the OLED display is not in the fail mode or ii) the multiplexed signal of a previous frame during an active period of the mask signal when the OLED display is in the fail mode.

19. The method of claim 18, wherein the fail enable signal includes an active period and an inactive period, and wherein the selectively outputting includes outputting the input data during the inactive period of the fail enable signal and outputting the fail data during the active period of the fail enable signal.

20. The method of claim 18, wherein the mask signal includes an active period and an inactive period, and wherein the mask signal is deactivated when the mask signal has the active period after a predetermined amount of time.

* * * * *